US005089296A

United States Patent [19]

Bafford et al.

[11] Patent Number: 5,089,296

[45] Date of Patent: Feb. 18, 1992

[54] FOAM SATURATION AND RELEASE COATING OF A FIBROUS SUBSTRATE

[75] Inventors: Richard A. Bafford, Aiken, S.C.; George E. Faircloth, Augusta, Ga.

[73] Assignee: Air Products and Chemicals, Inc., Allentown, Pa.

[21] Appl. No.: 489,586

[22] Filed: Mar. 30, 1990

Related U.S. Application Data

[63] Continuation of Ser. No. 174,411, Apr. 8, 1988.

[51] Int. Cl.[5] ..... B05D 5/10

[52] U.S. Cl. ..... 427/208; 427/208.4; 427/209; 427/350; 427/359; 427/411; 427/412; 427/420; 427/428

[58] Field of Search ..... 427/209, 208.4, 208, 427/294, 394, 359, 350, 420, 428

[56] References Cited

U.S. PATENT DOCUMENTS 4,118,526 10/1978 Gregorian et al. ..... 427/370
4,365,968 12/1982 Gregorian et al. ..... 427/350

*Primary Examiner*—Janyce Bell
*Attorney, Agent, or Firm*—Michael Leach; James C. Simmons; William F. Marsh

[57] ABSTRACT

A release coating is applied to a paper web or other woven or non-woven substrate in the form of a foam. A foamed saturant can also be applied to the paper web or other substrate followed by the application of a foamed or unfoamed release coating composition to the paper web, without an intermediate drying step between the application of the foamed saturant, and the application of the release coating.

22 Claims, 2 Drawing Sheets

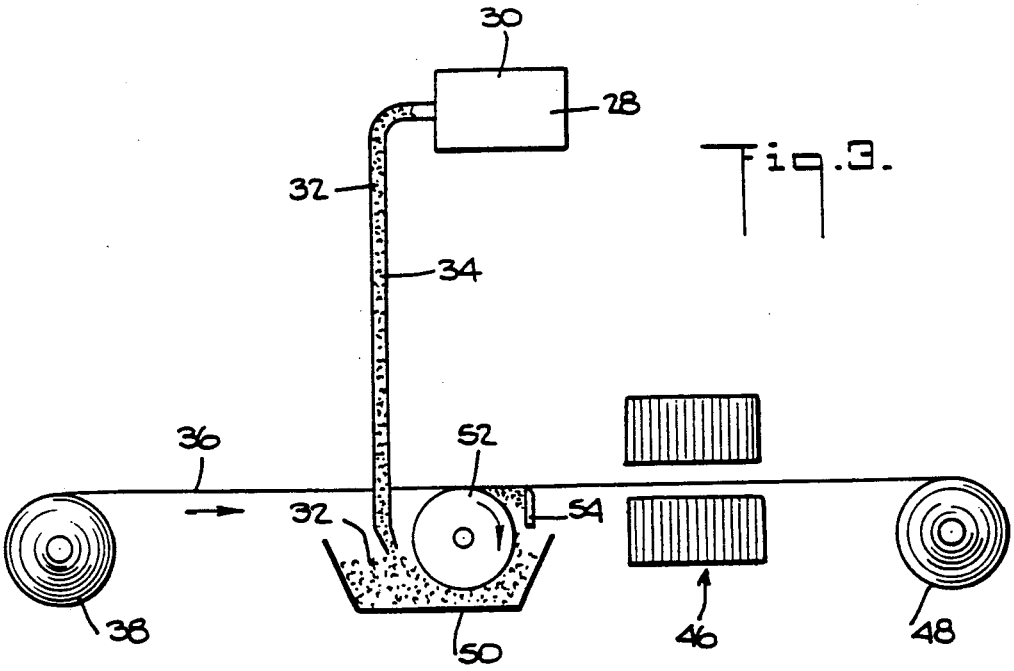
Fig. 3.
Fig. 4.
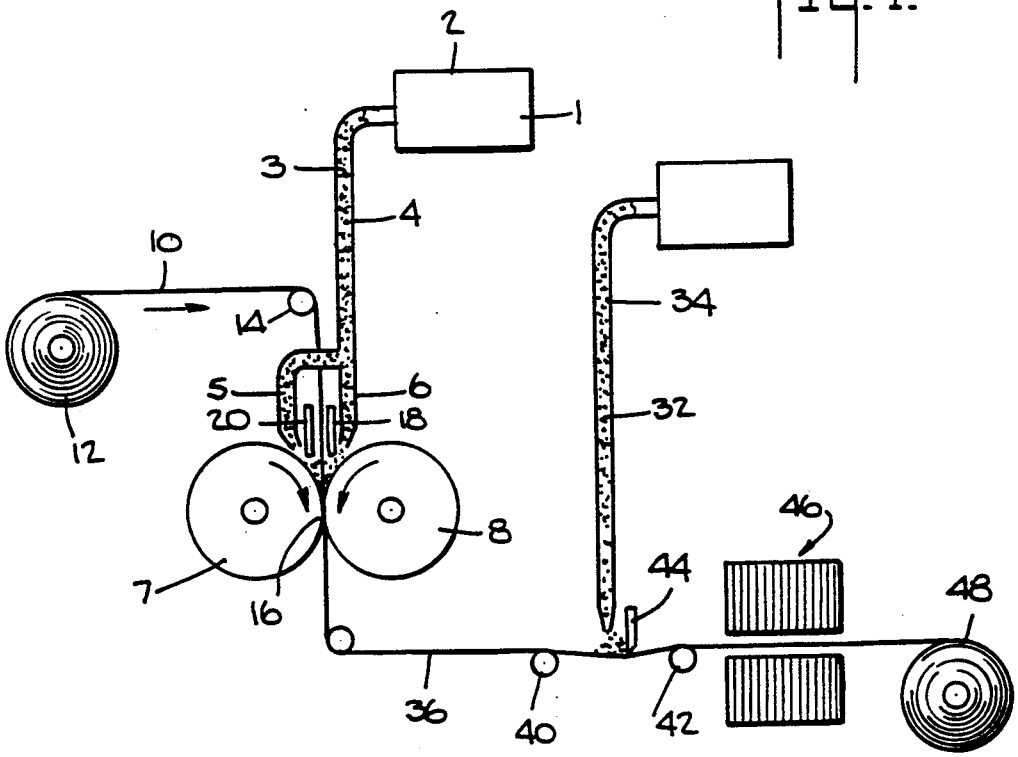

FOAM SATURATION AND RELEASE COATING OF A FIBROUS SUBSTRATE

This is a continuation, of application Ser. No. 07/179,411 filed Apr. 8, 1988.

BACKGROUND OF THE INVENTION

1. Field of the Invention

The present invention relates to sizing paper and the application of a release coating to a paper substrate, a nonwoven substrate, or a woven substrate.

2. Description of the Prior Art

A. Saturant Technology

In the manufacture of paper and paperboard from cellulosic material, it is customary to use a sizing agent either at the wet end, known as "internal sizing", or in the drying section of the paper making machine. This is done to increase the resistance of the paper or paperboard to wetting and penetration by liquids, particularly aqueous liquids, and thereby provides the paper product with water resistant properties.

The term "paper" as used in this invention refers to a web of felted or matted sheets of nonwoven cellulose fibers, formed on a fine wire screen from a dilute water suspension, and bonded together as the water is removed and the sheet is dried. Paper also refers to sheet materials produced from other types of fibers, particularly mineral or synthetic, which can be formed and bonded by other means. Of particular importance in the present invention, is the unbleached kraft paper commonly used in the manufacture of masking tapes and packaging tapes. Also of importance are nonwoven fiber or woven fiber substrates from synthetic or natural sources, such as nylon, rayon, cellulose diacetate, cellulose triacetate, polyamide resins, polyester resins, polyacrylic resins, polyvinyl resins, polyolefin resins, glass, metal, abaca, sisal, henequen jute, cotton, ramie, flax, hemp, silk, wool, mohair, cashmere, vicuna, alpaca, and the like.

The process of saturating or impregnating paper or a nonwoven fiber substrate with a resin or polymer is also known in the trade as sizing.

The application of a sizing agent to paper sheet or paperboard in the drying section of the papermaking machine is generally referred to as tub sizing. Partially dry sheet is passed through a size solution or over a roll wetted with size solution to saturate the paper. The same procedure can be applied to a nonwoven substrate but not generally to a woven substrate, which ordinarily has sufficient strength.

The two principal methods of sizing paper are the tub sizing method and off-machine saturation method. In tub sizing, the paper is contacted with the size while still on the paper machine and in a partially dry state. A relatively small percentage of manufactured paper is saturated by this method.

Where paper is used to make adhesive coated tapes, such as masking tapes or packaging tapes, it is necessary to improve its tensile strength and tear resistance by impregnating the paper with a resin or polymer to confer these properties. Also improved is delamination resistance, whereby the tendency to split in the plane of the paper is reduced.

When paper in the form of tape is coated with a pressure sensitive adhesive and the adhesive coated tape is wound upon itself to form a roll, as for example with masking tape or packing tape, it is also necessary to apply to the non-adhesive coated side of the tape, a controlled release coating, also known as "backsize" in order to facilitate the unwinding of the tape from the roll and its use.

If the tape cannot be unwound, or unwound only with great difficulty, it is said to be "blocking". Optimally, the tape must unwind in a controlled fashion so that only the amount desired for use is unwound from the roll. The tape should not be capable of unwinding in an uncontrolled manner when handled, so that more tape separates from the roll than the amount desired.

Suitable adhesives for pressure sensitive adhesive tape applications include tackified rubber adhesive solutions, tackified hot melt adhesives, tackified rubber emulsion adhesives and acrylic ester adhesives.

The majority of manufactured paper is saturated with a sizing composition, known as a "saturant", by means of an off-machine saturation method wherein the paper is saturated on a separate machine and is dry at the time of saturation. The conventional means for saturating paper in the off-machine method is to dip the paper in a dilute latex or resin emulsion, and then pass the paper between nip rollers under high pressure to remove excess resin or saturant. The paper is then passed through an oven to dry and set the resin.

The primary disadvantage of the conventional off-machine saturation method wherein the paper is dipped, and the excess resin is squeezed, lies in the large amount of water which becomes absorbed by the paper. For example, in the saturation of bleached crepe paper, used to produce masking tape, a normal dry add-on of styrene-butadiene-rubber (SBR) latex to achieve acceptable tensile and delamination properties is generally about 10 to 50% by weight of the dry paper.

In order not to exceed this add-on, the latex is usually applied from a dip bath having a solids level of about 25 to 30%. Wet pick-ups from a bath such as this range from about 75 to 150%. "Wet pick-up" refers to the weight of the added substance plus the vehicle, the weight of the web as a basis. Styrene-butadiene-rubber latices are manufactured at about 50 to 55% solids. It thus becomes necessary to dilute the latex with water in order to avoid adding more rubber solids to the paper than is necessary to achieve the desired tensile strength.

All water added must then be removed in drying ovens. Obviously, a significant amount of the energy expended in drying could be conserved if it were not necessary to dilute the latex with water. In addition, the running speed of a saturation range is generally controlled by the drying capacity of the ovens.

B. Release Coatings

When the sized paper is used to produce adhesive coated tapes, a controlled release coating, referred to as "backsize" is generally applied to the surface of the dry, saturated paper stock by coating a low solids polymer solution, such as that of acrylic ester copolymer resins, vinyl acetate copolymer resins, silicone resins, polyamide resins and polyester resins by conventional coating methods such as a kiss roll or a wire wound roll.

Historically, non-aqueous solvent solutions were generally used. However, due to environmental considerations, aqueous emulsions or latices have recently been introduced with much success, displacing the use of non-aqueous solvent solutions.

Controlled release latices are available at a level of about 40 to 50% solids, and are diluted with water to about 10 to 30% solids in order to meter the application of the release coating so that only a sufficient amount is used to achieve the desired release properties.

Unlike the saturant which must penetrate wetted paper, the controlled release coating is applied only on the surface of one side of the paper.

Silicone emulsions are also used for controlled release coatings, and are applied from emulsions containing about 2 to 10% silicone solids, since only small amounts of silicone are necessary to achieve the desired release properties.

As with the saturant, the ability to apply the release coating to the paper surface or other substrate using a high solids content emulsion would result in energy saving benefits in the dryer provided that the wet pickup is proportionately lower.

U.S. Pat. No. 4,571,360 to Brown et al discloses uniformly distributing paper treating agents onto paper without changing the properties of the paper by applying fast breaking and fast wetting foams. Ionic foaming agents were added to distribute the treating agent evenly to the paper. In all the examples starch was the treating agent. Foam may be applied to either side of the paper in multiple or two-sided applications, or sequentially.

U.S. Pat. No. 4,581,254 to Cunningham et al discloses applicators for uniformly distributing treating agents, such as cooked starch, to rapidly moving paper.

U.S. Pat. No. 4,597,831 to Anderson discloses application of water-repelling, external sizing such as rosin to the surface of paper. The rosin used was self-foaming and the use of foaming agents was discouraged.

U.S. Pat. No. 4,184,914 to Jenkins discloses the use of a foamed protein added to paper pulp before its entrance to the mesh of a papermaking machine in order to reduce the amount of water picked up by the pulp. The protein foaming agent also reduces the surface tension of the water.

The brochure "Foam Bonding - Dewtex" published by Rando Machine Corporation, Macedon, N.Y. discloses foam bonding of fabrics employing foamed synthetic rubber and polyvinyl acetate latices as adhesives.

U.S. Pat. No. 4,279,964 to Heller discloses densification of a high solids froth of a resin emulsion and a starch solution, or a frothed starch solution coated onto a paper substrate to increase its opacity and ink hold out.

U.S. Pat. No. 4,288,475 to Meeker teaches vacuum impregnation of a fibrous web by a foamed binder consisting of up to 60% of the weight of the material.

U.S. Pat. Nos. 4,193,762 to Namboodri; 4,118,526 to Gregorian et al; 4,094,913 to Walter et al and the text of a presentation by George C. Kantner, "Frothed and Foam Coatings for Upholstery and Nonwoven Fabric Applications" FOAM TECHNOLOGY IN TEXTILE PROCESSESS, (PD 186–03, July 30–31, 1985), all relate to treating fabrics with a foam composition.

SUMMARY OF THE INVENTION

The present invention relates to the application of a foam release coating to paper and other substrates. It also relates to the sequential application of a foamed saturant and of a foamed release coating to an appropriate substrate without an intermediate drying step.

BRIEF DESCRIPTION OF THE DRAWINGS

In the accompanying drawings,

FIG. 3 is a schematic drawing of foam application by means of a kiss roller;

FIG. 4 is a schematic drawing of sequential application of a foamed saturant and a foamed release coating without an intermediate drying step.

Corresponding reference numbers indicate corresponding parts throughout the figures of drawings.

DESCRIPTION OF THE PREFERRED EMBODIMENTS

Figure 1:
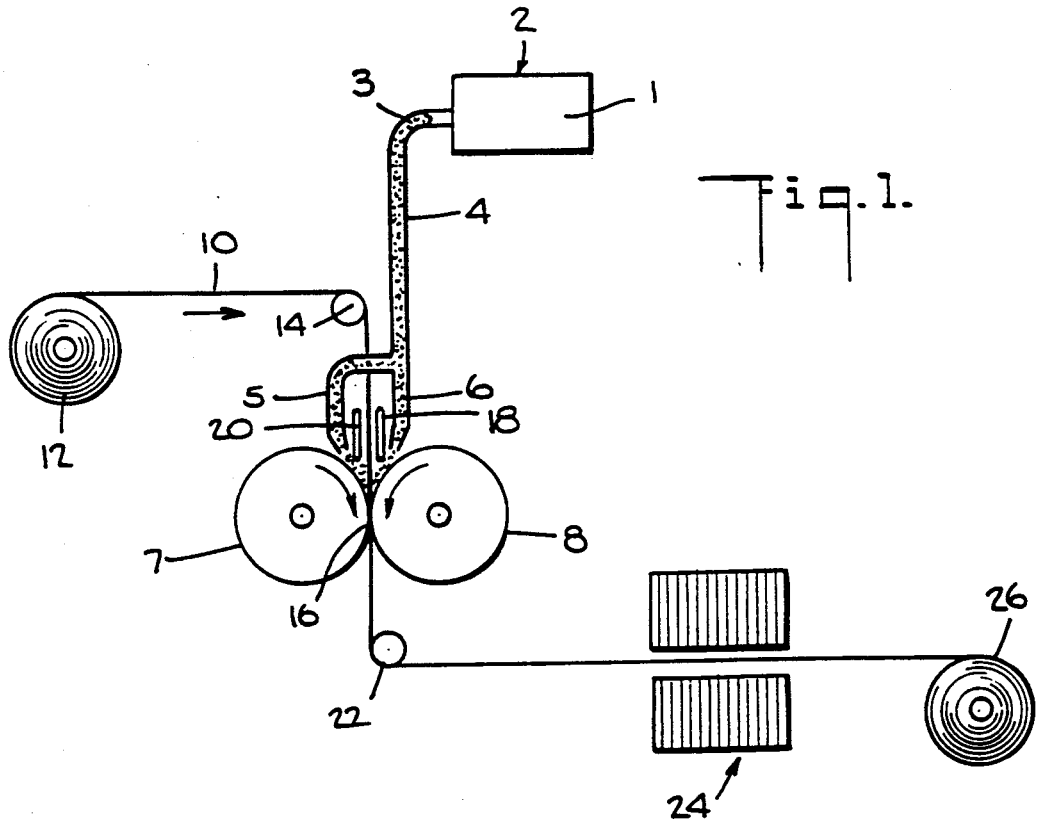
FIG. 1 is a schematic drawing of a coating apparatus.

In accordance with the present invention a release coating in the form of a foam is applied to paper or other substrate, such as woven or nonwoven fibers from natural or synthetic sources. The use of the release coating in the form of a foam reduces the amount of water that is necessary in the conventional manner of applying a release coating by aqueous dilution.

A high solids latex release coating can be converted to a foam by injecting air into the compounded latex in a mechanical foam generator. The viscous foam that is formed acts as a carrier for the release coating composition which can be contacted to the paper substrate by means of a variety of coating technologies known in the art.

The controlled release coating is also referred to by those skilled in the art as "backsize". Typical controlled release coatings include acrylic ester copolymer latices, vinyl acetate copolymer latices and silicone emulsions.

Suitable vinyl acetate copolymers include Valcoat-155 TM manufactured by Valchem corporation, 5649 TM manufactured by National Starch and Chemical Corporation and Sunaryl SM-3 TM manufactured by Sun Chemical Corporation. Suitable acrylic ester copolymer latexes include Valcoat-182 TM manufactured by Valchem Corporation and R225 TM manufactured by Rohm and Haas Corporation. Suitable silicone emulsions include GE2145/GE2156, a two part system manufactured by General Electric Corporation, and DC1171/DC1171A, a two part system manufactured by Dow Corning Corporation.

The ability to convert silicone emulsion release coatings into a foam was unexpected and surprising due to the fact that silicones are generally resistant to foaming, and are commonly used as a major ingredient in antifoam compositions.

The foamed release coating can be applied to a dry resin saturated paper. The resin saturated paper can be previously saturated by either conventional wet or foamed application of the saturant.

Typical saturants include natural rubber latices, styrene-butadiene emulsion polymers, polyacrylic ester emulsions, polyvinyl acetate emulsions, polyurethane emulsions and mixtures thereof. Solvent based saturants can also be used but are being phased out for commercial applications due to environmental considerations.

Suitable means for applying the foamed saturant composition to a fibrous substrate include horizontal pad roll applicators, such as the Reed-Chatwood and Dewtex; slot die foam applicators, such as the Gaston County and rotary screen applicators, such as the Stork Brabant RSF.

Suitable means for applying the foamed release composition to a fibrous substrate include floating knife applicators, kiss roll applicators, and slot die foam applicators, such as the Gaston County.

When the foam release coating is applied to a dry resin saturated paper, the nature of the saturant and mode of saturation is irrelevant. However, where sequential application of foamed saturant and foamed release coating is carried out without an intermediate drying step, it is preferred that both saturant and release coating be composed of water based systems.

Most emulsion polymers in the trade contain defoamers. This is because in conventional wet applications, foaming can cause variations in the amount of emulsion polymer added to the web. It is preferred that the latexes used in the present invention contain no defoamer.

The foamed saturant and foamed controlled release coating can be applied to the paper web or other substrate sequentially with an intermediate drying step. An intermediate drying step between the application of the saturant and the application of the controlled release coating is necessary in conventional aqueous dilution processes. However, in another embodiment of the present invention, the use of foam allows for the sequential application of saturant and release coating without an intermediate drying step.

In a further embodiment of the invention, the release coating can be applied to the paper web or other substrate in an unfoamed state subsequent to the application of the foamed saturant, without an intermediate drying step.

The elimination of the intermediate drying step cannot be accomplished in conventional aqueous dilution saturation and release coating applications because the high water content of the paper web after saturation would allow resin particles to migrate into the wet release coating, which would ruin its release properties, and it would be difficult to control wet pick-up on a already water saturated web.

After the release coating composition has been applied to the paper web or other substrate, it can be dried in suitable drying equipment known to the art. The drying temperatures can vary from about 150° to 450° F., preferably about 200° to 350° F. Suitable drying means include gas fired ovens, steam heated cans, and the like.

In designing foamable systems, the selection of foaming aids and foam stabilizers is important to the successful operation and application of the foamed saturant and foamed release coating. Selection is critical so that the foaming aid does not adversely affect the desired properties of the treated paper. For example, certain foaming agents and saturants can make the paper hydrophilic, which defeats the purpose of imparting water resistance. With regard to the release coating, improperly selected foaming agents can adversely affect the release properties and cause the adhesive coated paper on an adhesive tape to block. Blocking occurs when a roll of adhesive tape cannot be unwound. The foaming agent can also migrate from the release coating into the adhesive layer, causing detackification.

Additives must be selected which will not interfere with the release properties of the controlled release coating, or detackify the subsequently coated pressure sensitive adhesive.

Moreover, if the foam collapses prematurely, the paper web would absorb an excessive amount of liquid. Alternatively, if the foam is too stable, the saturant will not completely penetrate the web and the paper will lack delamination resistance. As already noted, the foamable saturant is designed to penetrate the paper web whereas the foamable release coating is contacted to the paper web in a manner such that it exists primarily on its surface.

Typical foaming agents include sodium lauryl sulfate, ammonium stearate, fatty acid diethanolamide, and ethoxylated fatty acids. The amount of foaming agent can vary from about 0.02 to 5%, and preferably about 0.05 to 2% by weight of the saturant or release composition. As a general rule, the least amount of foaming agent necessary to provide a foam of the desired stability is used since foaming agents can, if used in excess, adversely effect water resistance and release properties of the final saturated and release coated substrate.

Optionally, foam stabilizers are employed to increase the stability of the foam. In the present invention, foam must be sufficiently stable so that it will not collapse unless an external force such as compression or a vacuum is applied to the foam. Typical stabilizers for the foam include hydroxyethyl cellulose, ammonium polyacrylate, methoxyethyl cellulose, and hydroxypropyl cellulose.

The foams used in this invention contain gas and the foamable saturant, or the controlled release coating. The gas which comprises the vapor component of the foam can be any gasous material capable of forming a foam with the saturant or release composition. Typical suitable gases include, air, nitrogen, oxygen and inert gases, with air being the preferred foaming gas.

In making the foams, the volume ratio of gas to liquid is known as the "blow ratio". Thus, a foam using air as the gas and having a blow ratio of 15 consists of 14 parts of air and 1 part of the liquid treating composition. Generally, the blow ratio is determined by dividing the weight of a given volume of unfoamed liquid by the weight of a equal volume of the foam.

The selection of blow ratio is dictated by the nature of the paper web or other substrate, and whether saturation or a surface release coating is desired, and by the coating speed. For paper saturation, the blow ratio generally ranges from about 1.5 to about 25, preferably from about 5 to 15. For a controlled release coating composition, the blow ratio can range from about 5 to about 30, preferably from about 5 to 20. Where both the saturant and the release coating are to be applied as foams sequentially, the saturant is applied first, and for any given paper web or other substrate, the preferred blow ratio of the saturant will be lower than that for the release coating.

The foam compositions of the present invention require an external force, such as mechanical compression or vacuum in order to collapse. This is in contrast to the fast-breaking foams disclosed in U.S. Pat. No. 4,571,360 to Brown which collapse merely on contacting a substrate.

The saturant composition, after collapse of the foam is fast wetting, that is, after the foam collapses, the saturant is rapidly absorbed into the surface, and penetrates and impregnates the paper web or other substrate, evenly distributing itself throughout.

The foamed release coating composition after collapse by external force such as mechanical compression or vacuum, is preferably not fast-wetting so that the coating remains on the surface of the web or substrate.

As noted, foams can be generated by injecting air and the compounded liquid treating composition into a mechanical foam generator available commercially, such as the known static, radial or axial types. Foam generation means generally consist of a mechanical agitator capable of mixing metered quantities of gas and liquid treating compositions.

The foaming is controlled by adjusting the blow ratio and the rotation rate of the rotor in the foaming apparatus to provide a foam having the desired bubble size and half life. The relative feed rates of the liquid treating composition in the gas will determine the density of the foam.

Suitable foamers include the Texacote TM foamer (U.S. Rubber and Textile Company, Dalton, Ga.), and the Oakes TM foamer (Oakes Machinery Corporation, Long Island, N.Y.). Static foamers can also be used such as the Valfoamer TM (Southern Machine and Sales Company, Inc., Cheraw, S.C.). On a laboratory scale, common household mixers, such as the Kitchenaid TM mixer (Hobart Corp., Troy, Ohio), and other household mixers made by Oster Co., Hamilton Beach Co., and Waring Co., can also be used, equipped with a wire whip to produce the foam.

One method for applying the saturant is to use a coating operation shown schematically in FIG. 1, wherein air and the saturant composition are (1) foamed in a mechanical foaming device (2) which produces the foamed saturant composition (3) which passes through foamed delivery pipe (4) and divides into distribution points (5) and (6), which release foam onto horizontal padder rolls (7) and (8). The paper web (10) unwinds from letoff roll (12) and passes over idler roller (14) where it continues its passage through horizontal padder rolls (7) and (8) and contacts the foamed saturant (3) being released from foam distributors (5) and (6) in the nip roll section (16) wherein the foamed saturant (3) is compressed and collapses into the liquid state and penetrates the paper web (10) from both sides of the paper. Optional movable gates (18) and (20) restrict the contact time between the foam and the paper web (10), and if necessary can be adjusted to block the foam entirely from contacting the paper web (10). The compression pressure on the paper web (10) exerted by the nip rolls (16) of the horizontal padder rolls (7) and (8) is adjusted to meter the desired amount of foam so that no excess liquid formed after the collapse of the foamed saturant exists after compression. The paper web (10) then continues its passage over idler roller (22) through dryer (24) and onto takeup roll (26). The foamable saturant (3) is formulated so that the foam is sufficiently stable to be delivered to the horizontal padder rolls (7) and (8) without collapsing. However, the foamed saturant instantaneously collapses into a liquid when subjected to the pressure applied in the nip roll section (16).

The examples which follow illustrate specific embodiments of the present invention. All parts and percentages are by weight unless otherwise indicated. Examples 1 to 3 demonstrate foam saturation of a paper substrate. Examples 4 to 7 demonstrate foam application of a release coating. Example 8 shows the sequential application of a foamable saturant and a release coating without an intermediate drying step, and Example 9 shows a foamed silicone release coating.

Example 1

A foamable paper saturant formulation was prepared by mixing 100 parts of a 60:40 styrene-butadiene-rubber (SBR) latex, 55% solids, defoamer free (Walsh Chemical Co., Morganton N.C.); 2 parts ethoxylated fatty alcohol sold under the name Valdet TM -4016, (Valchem Chemical Co., Langley, S.C.) and 1 part hydroxyethylcellulose solution (Stabilizer 341 TM, Valchem Chemical Co., Langley, S.C.). The mixture was foamed to a blow ratio of 5 in an Oakes foamer.

A 26 pound unbleached crepe kraft paper web, was fed through a pair of horizontal pad rolls, one steel, and one hard rubber at a rate of 30 feet per minute with a nip pressure of 30 psi. The foam was applied to both sides of the web as it traversed the pad rolls. The web was cut into sections and each section was dried in a gas fired oven at 325° C. for 10 seconds. The amount of saturant and physical properties of the paper product are detailed in Table 1.

Example 2

The rubber latex saturant formulation of Example 1 was foamed with air to a blow ratio of 11. The same unbleached crepe kraft paper as in Example 1 was fed through a Reed-Chatwood pilot horizontal pad foam applicator, with foam applied to both sides of the web. The paper was impregnated with saturant, and dried on steam heated cans, at 220° F. at a rate of 60 feet per minute. The amount of saturant and physical properties of the paper product are detailed in Table 1.

Example 3

An acrylic copolymer latex of 50% solids, having a glass transition temperature ($T_g$) of −10° C. and sold commercially as Valbond 386-9, (Valchem Chemical Co.) was foamed in Texacote foaming machine to a blow ratio of 10. The foam was applied to a 26 pound kraft paper using the pilot foam applicator of Example 2. The product was dried 220° F. at a rate of 60 feet per minute. The amount of saturant and physical properties of the treated web paper are detailed in Table 1.

TABLE 1

PHYSICAL PROPERTIES OF SATURATED KRAFT PAPER

| | % Wet Add-On | % Dry Add-On | Tensile Strength (lbs/in.) | Blow Ratio |
|---|---|---|---|---|
| Untreated Paper | — | — | 13.4 | — |
| Conventionally Saturated Paper | 87 | 26 | 19.9 | — |
| Example 1 | 100 | 54 | 18.6 | 5 |
| Example 2 | 48 | 26 | 17.8 | 11 |
| Example 3 | 74 | 37 | 21.4 | 10 |

The data in Table 1, demonstrates that in Example 1 the blow ratio of 5 was too low, resulting in excessive dry add-on. Higher dry add-on does not contribute to improved tensile strength. In Example 2 where the blow ratio was 11, the dry add-on was reduced to the conventional level resulting in a small reduction in tensile strength. Example 3, with an intermediate amount of % wet and % dry add-on for the acrylic copolymer latex resulted in a higher tensile strength than that of Examples 1 and 2.

For the conventionally applied saturant, the paper was dipped in a bath containing 25% solid styrene-butadiene latex. The wet paper was compressed using a vertical padder to remove excess latex. The water to be evaporated per pound of paper was 0.61 pounds or 47.6 pounds per 1,000 square yards of 26 pound kraft paper.

For the foam application of Example 2, 0.22 pounds of water per pound of paper or 17.2 pounds per 1,000 square yards of 26 pound kraft paper was evaporated.

Thus energy consumption for drying was reduced by about 65%. If processing speed is dictated by drying capacity of the oven, processing speed can be increased by 65%. Foam processing reduces energy costs while increasing productivity.

Example 4

Figure 2:
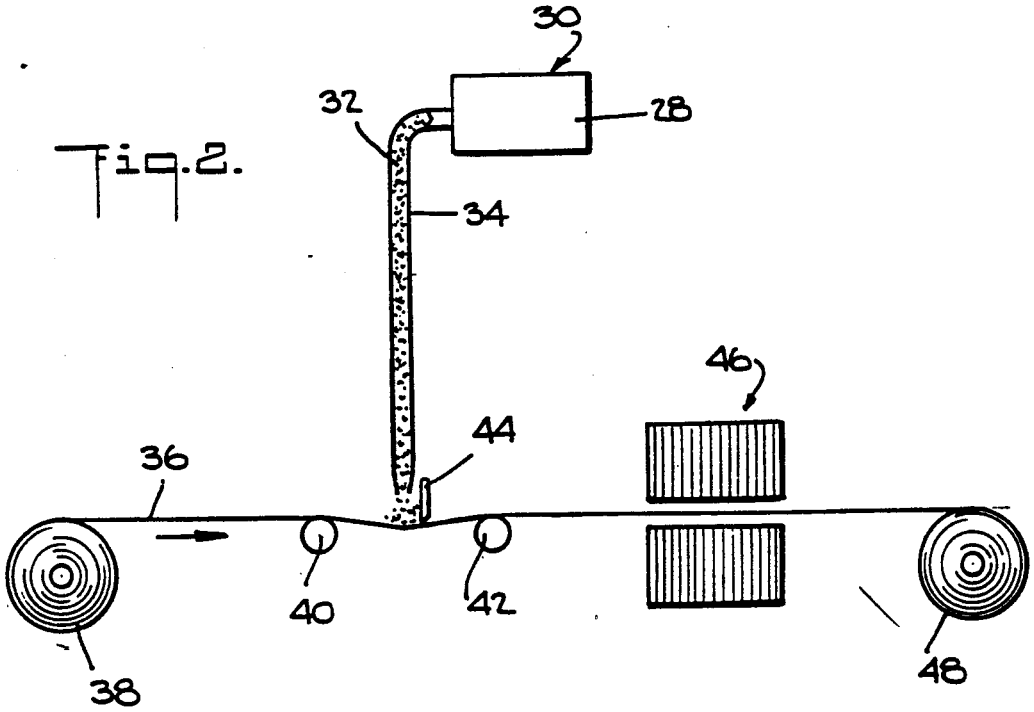
FIG. 2 is a schematic drawing of a floating knife arrangement.

An aqueous acrylic release coating sold under the name Valcoat 182 TM (Valchem Chemical Co.) was foamed to a blow ratio of 11:1. The foam was applied to one side of a saturated crepe paper using a floating knife arrangement as shown in FIG. 2, wherein air and the release coating (28) were foamed in mechanical foamer (30) to form a foamed release coating (32) passing through foam delivery pipe (34) which released the foam onto the surface of the paper web (36). The paper web (36), which can be previously treated with saturant was unrolled from letoff roll (38) and passed over support rolls (40) and (42), where the paper web (36) contacted the foam (32) which was metered onto the surface of the paper web (36) by means of coating knife (44), which caused the foam to collapse into a liquid. The proportion of foam (32) metered onto the surface of the paper was controlled by the pressure of the coating knife (44) in such a manner that no excess liquid was left after the foam (32) collapsed into a liquid in sufficient amounts to coat the surface of the paper web (36) with the release coating. The treated paper web (36) then passed into the steam can dryer (46), finally being collected at takeup roll (48). The coating speed was 30 ft/min. Control parameters and release properties are detailed in Table 2.

Example 5

The same acrylic release coating used in Example 4 and foamed to a blow ratio of 8:1, was coated on the same saturated paper under the same conditions of Example 4. The paper was dried in a gas-fired oven. Control parameters and release properties are detailed in Table 2.

Example 6

The same release coating used in Example 4 was foamed to a blow ratio of 8:1 and coated on a 26 pound saturated masking paper using the floating knife arrangement in FIG. 2. In the same operation the paper was dried and a solvent based natural rubber adhesive was applied to the other side and dried. The running speed for this trial was 600 ft/min. The control parameters and release properties of the masking tape produced in this trial are detailed in Table 2.

Example 7

The same acrylic release coating used in Example 4 was foamed to a blow ratio of 8:1 and applied to a 26 pound saturated crepe paper, with a kiss roller, followed by a scrape blade in accordance with FIG. 3, wherein air and release coating (28) were foamed in mechanical foamer (30) to form foamed release coating (32) which passed through foam delivery pipe (34) where it was released and collected in collection vessel (50) housing a kiss roller (52) which collected the foam release coating (32) and transferred it to the underside surface of the paper web (36) which unrolled from letoff roller (38) and traversed over the kiss roller (52). The foamed release coating (32) was metered onto the underside surface of the paper web (36) by the scrape blade (54), which also collapsed the foam, allowing any excess to drip back into vessel (50). The release coated paper web (36) then passed through dryer (46) and was collected on takeup roll (48). After drying the paper, an adhesive was applied under the same conditioning as in Example 6. The production running speed was 650 ft/min.

Table 2 shows the control parameters and release properties of the finished masking tape.

Example 8

The SBR foamed latex saturant of Example 1 was foamed with air to a 6:1 blow ratio and applied to a 26 pound unbleached crepe paper as in Example 1. Without an intermediate drying step, the saturant impregnated paper web was then coated on the surface of one side with the same foamed acrylic release coating as in Example 4 at a blow ratio of 11:1 with a floating knife apparatus. The procedure is shown schematically in FIG. 4, wherein air and the saturant composition (1) were mechanically foamed in foamer (2) to form foamed saturant (3) which passed through foam delivery pipe (4) through foam distributors (5) and (6) where foamed saturant (3) was released on horizontal pads (7) and (8) which contacted the paper web (10) collapsing the foamed saturant into a liquid where it was impregnated in the paper web (10), much in the manner of FIG. 1, except that the saturant impregnated paper web (36), without an intermediate drying step, then contacted foamed release coating (32) by means of a coating knife applicator (44), which metered and collapsed the foamed release coating (32) onto the surface of the paper web (10), which then passed to dryer (46) and takeup roll (48), similar to the operation of FIG. 2. The release coating can also be applied with other means known to the art, such as the kiss roll disclosed in FIG. 3. The control parameters and release properties of this product are also detailed in Table 2.

A general purpose masking tape manufactured by Anchor Continental Co. of Columbia, S.C., was used to test release papers listed in Table 2, which follows. The "conventional paper" in Table 2 is that used to prepare the general purpose masking tape. The conventional paper was saturated by being dipped into a 25% solids bath of stryrene-butadiene latex polymer, squeezed through pad rolls to remove excess latex and then dried. One side of the paper was then kiss coated with a 28% solids acrylic ester copolymer latex release coating and dried. As shown in Table 2, the wet add-on of release coating was 21% and the dry add-on was 4.0%.

TABLE 2

PHYSICAL PROPERTIES OF FOAM COATED RELEASE PAPERS

| | Release Coating % Wet Add-on/ % Dry Add-on | Adhesion to Release Backing (oz/in) | Re-adhesion (oz/in) | Roll Ball (cm.) |
|---|---|---|---|---|
| Untreated Paper | — | 21 | 20 | .5 |
| Conventional Paper | 21/4.0 | 6.9 | 31 | .5 |
| Example 4 | 6.8/3 | 7.2 | 32 | .5 |
| Example 5 | 8.4/3.7 | 7.1 | 30 | .5 |
| Example 6 | 7.9/3.5 | 6.8 | 30 | .5 |
| Example 7 | 8.8/3.9 | 6.3 | 31 | .5 |
| Example 8[a] | 13.6/6.0 | 4.9 | 32 | 2.3 |

[a]Saturant Wet Add-on: 75%
Saturant Dry Add-on: 41%
Tensile strength after saturation: 24 lbs./in
Roll Ball Test (PSTC-6, Pressure Sensitive Tape Council)

Readhesion is a measure of the peel strength of the adhesive measured against a stainless steel plate after the adhesive has been contact with a release coating for 20 minutes. This is a modification of PSTC-1.

The data demonstrate that the foam application of the high solids (undiluted) release coating results in a product with performance characteristics equivalent to that of a conventionally applied release coating. However, the water required to apply the release coating was reduced by 60 to 80%, thereby reducing energy consumption by the same proportion.

EXAMPLE 9

Two aqueous silicone release coatings were prepared. A conventional coating consisted of:

| | Parts |
|---|---|
| Water | 327 |
| Acetic Acid | 0.1 |
| Silicone GE2145 (General Electric) | 31 |
| Catalyst GE2126C (General Electric) | 7.56 |
| | 365.66 |
| A foamable coating consisted of: | |
| Water | 228 |
| Acetic Acid | 0.2 |
| Silicone GE2145 (General Electric) | 62 |
| Catalyst GE2126C (General Electric) | 15 |
| Sodium lauryl sulfate (Sipex UB, Alcolac Co., Baltimore, MD) | 4.5 |
| | 309.7 |

The conventional coating was applied to a 35 pound machine finished paper using a wire wound rod coater. The foamable coating was foamed to a blow ratio of 13 to 1 and applied to the machine finished paper using a floating knife applicator.

The coated papers were dried in a oven. Both release papers were then coated with a butyl acrylate/vinyl acetate emulsion copolymer pressure sensitive adhesive Valtac 28ST (Valchem Co.). The coatings were dried and laminated to a white 3 mil vinyl film, by passing through pad rolls at 30 psi.

The wet and dry coating weights of release coating, the dry coating weight of adhesive, the peel adhesion of the adhesive coated vinyl and the force necessary to peel the release coated paper from the adhesive coated vinyl (adhesion to release paper) are recorded in Table 3.

It is evident that the performance of the foam applied release coating is equivalent to the conventionally applied coating but the foamed coating was applied using 51% less water corresponding to a comparable percentage energy saving during drying.

TABLE 3

| SILICONE RELEASE COATING | Foam | Conventional |
|---|---|---|
| Wet add-on of release (lbs/ream)[a] | 3.1 | 6.0 |
| Dry add-on of release (lbs/ream)[a] | .29 | .27 |
| Dry add-on of adhesive (oz/yd$^2$) | .42 | .42 |
| Adhesion to release paper (gms/in) | 20 | 19 |
| Peel adhesion to stainless steel (gms/in) | 206 | 181 |

[a]area of ream = 3,000 ft$^2$

What is claimed is:

1. A method for making a pressure sensitive adhesive tape comprising:

(a) forming a foam composition containing a sufficient amount of a release coating for a pressure sensitive adhesive and having a blow ratio of about 5 to 30;

(b) contacting the foamed release coating composition onto the surface of one side of a substrate which is a paper or a woven or non-woven fabric and collapsing the foam into a liquid in sufficient amount to coat and remain on the surface;

(c) drying the substrate; and (d) applying a coating of a pressure sensitive adhesive to the surface of the substrate opposite to the surface coated with the release coating composition.

2. The method of claim 1, wherein said fibrous substrate comprises a woven or non-woven material selected from the group consisting of cellulose, nylon, rayon, cellulose diacetate, cellulose triacetate, polyamide resins, polyester resins, polyacrylic resins, polyvinyl resins, polyolefin resins, glass, metal, abaca, sisal, henequen, jute, cotton, ramie, flax, hemp, silk, wool, mohair, cashmere, vicuna, alpaca, and mixtures thereof.

3. The method of claim 1, wherein said the release coating is selected from the group consisting of acrylic ester copolymer resins, vinyl acetate copolymer resins, silicone resins, polyamide resins and polyester resins.

4. The method of claim 3, wherein the release coating is a latex selected from the group consisting of acrylic ester copolymers, vinyl acetate copolymers, and silicone resins.

5. The method of claim 1, wherein the foamed release composition has a blow ratio varying from about 5 to about 20.

6. The method of claim 1, wherein prior to the application of the release coating, a foam composition is formed containing a sufficient amount of saturant, and said foamed saturant is contacted onto a paper web and collapsed, thereby impregnating said substrate with said saturant, followed by the application of the foamed release coating without an intermediate drying step.

7. The method of claim 6, wherein said saturant is selected from the group consisting of natural rubber latices, styrene-butadiene rubber emulsion polymer latices, polyacrylic ester emulsions, polyvinyl acetate emulsions, polyurethane emulsions, and mixtures thereof.

8. The method of claim 7, wherein the foamed saturant has a blow ratio varying from about 1.5 to about 25.

9. The method of claim 8, wherein the blow ratio of the foamed saturant is lower than the blow ratio of the foamed release composition.

10. The method of claim 1, wherein said adhesive is selected from the group consisting of tackified rubber, tackified hot melt adhesives, tackified rubber emulsion adhesives, acrylic ester polymer adhesives and mixtures thereof.

11. The method of claim 6, wherein the foam is formed in a mechanical foam generator using a gas selected from the group consisting of air, nitrogen, oxygen, inert gases, and mixtures thereof.

12. The method of claim 6, wherein the foamed saturant or foamed release composition contains a foaming agent selected from the group consisting of sodium lauryl sulfate, ammonium stearate, fatty acid diethanolamide, ethoxylated fatty acids, and mixtures thereof.

13. The method of claim 12, wherein the amount of foaming agent varies from about 0.02 to about 5% by weight of the respective saturant or release composition.

14. The method of claim 1, wherein the foaming gas is air.

15. The method of claim 1, wherein the drying temperature varies from about 150° to 450° Fahrenheit.

16. The method of claim 1, wherein said foam is collapsed by an external force selected from the group consisting of compression or vacuum.

17. The method of claim 6, wherein said foam is collapsed by an external force selected from the group consisting of compression or vacuum.

18. The method of claim 1, wherein said substrate is paper.

19. The method of claim 1, wherein said substrate is a non-woven fabric.

20. The method of claim 1, wherein said foamed release coating composition is contacted onto said substrate by means selected from the group consisting of a floating knife applicator, a kiss roll applicator, and a slot die foam applicator.

21. The method of claim 1, wherein said foamed saturant is contacted onto said substrate by means selected from the group consisting of a horizontal pad roll applicator, a slot die foam applicator, and a rotary screen applicator.

22. A method for making a pressure sensitive adhesive tape comprising:

(a) forming a foam composition containing a sufficient amount of a saturant;

(b) contacting the foamed saturant onto a fibrous substrate which is a paper or a woven or non-woven fabric and collapsing the foam, thereby impregnating the fibrous substrate with the saturant;

(c) forming a foam release coating composition containing a sufficient amount of a release coating for a pressure sensitive adhesive and having a blow ratio of about 5-30;

(d) contacting the foamed release coating composition onto the surface of one side of the fibrous substrate following the impregnation of the saturant without an intermediate drying step;

(e) collapsing the foamed release coating composition into a liquid in sufficient amount to coat and remain on the surface;

(f) drying the saturant impregnated, release coated fibrous substrate; and (g) applying a coating of pressure sensitive adhesive to the surface of the fibrous substrate opposite the surface coated with the release coating composition.

* * * * *